US010798782B2

(12) United States Patent
Bäumler et al.

(10) Patent No.: US 10,798,782 B2
(45) Date of Patent: Oct. 6, 2020

(54) METHOD AND DEVICE FOR PLACING COLLECTION STRIPS IN FILMS

(71) Applicant: Hotlineglass GmbH, Aachen (DE)

(72) Inventors: Peter Bäumler, Aachen (DE); Stephan Bäumler, Aachen (DE); Sebastian Wicka, Aachen (DE)

(73) Assignee: Hotlineglass GmbH, Aachen (DE)

( * ) Notice: Subject to any disclaimer, the term of this patent is extended or adjusted under 35 U.S.C. 154(b) by 0 days.

(21) Appl. No.: 16/341,347

(22) PCT Filed: Oct. 13, 2017

(86) PCT No.: PCT/DE2017/100875
§ 371 (c)(1),
(2) Date: Apr. 11, 2019

(87) PCT Pub. No.: WO2018/068794
PCT Pub. Date: Apr. 19, 2018

(65) Prior Publication Data

US 2019/0246456 A1 Aug. 8, 2019

(30) Foreign Application Priority Data

Oct. 14, 2016 (DE) ..... 10 2016 119 678

(51) Int. Cl.
*H05B 3/02* (2006.01)
*H01C 17/28* (2006.01)
(Continued)

(52) U.S. Cl.
CPC ..... *H05B 3/0095* (2013.01); *H05B 3/84* (2013.01); *H05B 2203/011* (2013.01); *H05B 2203/014* (2013.01); *H05B 2203/017* (2013.01)

(58) Field of Classification Search
CPC ..... H05B 2203/011; H05B 2203/014; H05B 2203/016; H05B 2203/017; H05B 3/0095;
(Continued)

(56) References Cited

U.S. PATENT DOCUMENTS 3,349,359 A * 10/1967 Morey ..... H05B 3/342 338/208
5,501,007 A * 3/1996 Kuma ..... B01D 53/0407 29/846
(Continued)

FOREIGN PATENT DOCUMENTS

| | | |
|---|---|---|
| DE | 2127693 | 1/1973 |
| WO | 2004077496 | 9/2004 |
| WO | 2006010346 | 2/2006 |

OTHER PUBLICATIONS

International Search Report and Written Opinion for PCT/DE2017/100875, European Patent Office, dated Feb. 12, 2018.

*Primary Examiner* — Sang Y Paik
(74) *Attorney, Agent, or Firm* — Williams Mullen; Thomas f. Bergert

(57) ABSTRACT

In a method and a device for laying busbars (5, 31, 33) in films, in which a bundle of heating wires (32) and at least two busbars (5, 31, 33), each electrically contacting at least one subset of the heating wires (32), are applied to at least one base film (3, 14-17, 21-24, 30), wherein the busbars (5, 31, 33) are each guided by a guide unit (35) in the direction of a pressure roller (1) and are pressed by the pressure roller (1) in the direction of the base film (3, 14-17, 21-24, 30) and are cut by a cutting device (8), it is proposed that the busbars (5, 31, 33) are each cut before the pressure roller (1) in the supply direction.

18 Claims, 3 Drawing Sheets

(51) Int. Cl.
*H05B 3/00* (2006.01)
*H05B 3/84* (2006.01)

(58) Field of Classification Search
CPC . H05B 3/20; H05B 3/26; H05B 3/267; H05B 3/34; H05B 3/342; H05B 3/345; H05B 3/347; H05B 3/84
USPC ..... 219/469, 541–549; 29/610.1–611, 29/619–621
See application file for complete search history.

(56) References Cited

U.S. PATENT DOCUMENTS

| | | | | |
|---|---|---|---|---|
| 6,483,087 | B2 * | 11/2002 | Gardner | B29C 70/82 219/545 |
| 2007/0281049 | A1 | 12/2007 | Pereira | |
| 2012/0145072 | A1 * | 6/2012 | Ichikawa | H01B 13/345 118/33 |
| 2016/0021705 | A1 * | 1/2016 | Barfuss | H05B 3/145 219/553 |

* cited by examiner

METHOD AND DEVICE FOR PLACING COLLECTION STRIPS IN FILMS

CROSS-REFERENCE TO RELATED APPLICATIONS

This application is the U.S. national phase of international application PCT/DE2017/100875, filed on Oct. 13, 2017, which claims the benefit of German Patent Application 10 2016 119 678.9 filed on Oct. 14, 2016; all of which are hereby incorporated herein in their entirety by reference.

The invention relates to a method for laying busbars in films according to the preamble of claim 1 and a device for laying busbars in films according to the preamble of claim 9.

Heatable panes of glass generally have heating wires heatable via electrical resistance, which are laid between films and are electrically contacted via busbars. The heating wires typically contact the busbars via a soldered joint, wherein the wire ends are arranged in a sandwich structure between an upper and a lower busbar of a busbar pair. Moreover, the busbar pairs have power terminals for the power supply. In the finished pane of glass, the films are laminated in with the heating wires and busbars between two partial panes. Such heatable panes of glass are used in particular in motor vehicles. In particular the use in the automotive field, for example, for windshields, has the result that the busbars predominantly extend in a curve, for example, along the upper and/or lower longitudinal edge of the pane of glass.

A device and a method are known from DE 69607563 T2, for automatically laying films with heating wires. For this purpose, multiple films are laid on a winding drum and the heating wires are pressed by means of a heating wire laying device on the films. The manner of the application of the busbars is not described in the above-mentioned document. The laying of the busbar is often performed manually.

The lower busbar has to be attached before the application of the heating wires. After the wires are applied, the upper busbar is applied and soldered to the heating wires and the lower busbar. Providing a busbar soldering device on a winding drum parallel to the winding axis is generally known, the busbar soldering device having driven longitudinal and transverse axes and rotational drive vertically above a pressure roller used as a solder roller, so that the soldering process can be performed semi-automatically.

The manual laying of the busbars and semi-automatic soldering are time-consuming. In, particular, manual handling, which is frequently required for accurate placement of the starting points or end points of the busbars, and the manual removal of heretofore unavoidable remaining pieces are disadvantageous.

A method and a device of the type mentioned at the outset are known from the Italian company Easy Automation, Rome, (www.easyautomation.it), which enable automatic laying of busbars. Film-type busbars are supplied to a pressure roller from a stock. The busbars laid on the film are then cut off, wherein a piece of busbar naturally remains behind the pressure point of the pressure roller. It is therefore necessary to cut off the remaining piece upon laying of the next busbar.

The invention is based on the object of providing a method and a device of the type mentioned at the outset which are accompanied by improved automation ability in particular for mass production of such films for panes of glass of such films.

The object is achieved with respect to the method by the characterizing features of claim 1 and with respect to the device by the characterizing features of claim 9. Advantageous embodiments result from the dependent claims.

Exemplary embodiments of the method according to the invention and the device according to the invention are explained hereafter on the basis of figures.

Figure 1:
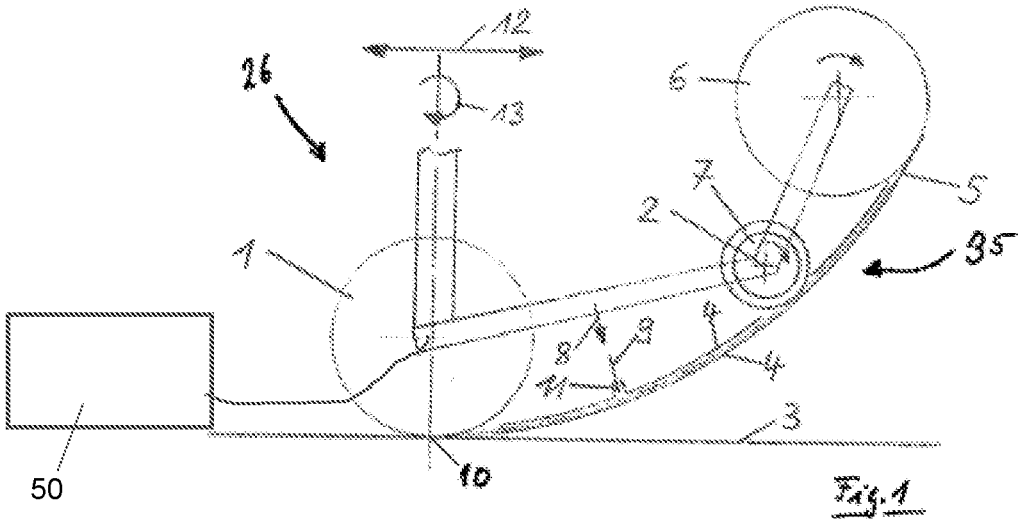
FIG. 1 shows a front view of a busbar laying unit and guide unit in accordance with embodiments of the present disclosure.

FIG. 1 shows a busbar laying unit 26 having a pressure roller 1, by means of which a busbar 5 can be pressed in the direction onto a base film 3, for example, made of polyvinyl butylene (PVB). The base film 3 is located on a film underlay (not shown here), for example, a flat table (not shown here) or preferably on a winding drum 34 (see FIGS. 2 and 3). The busbar laying unit 26 can be mounted on the film support. If the film support is a winding drum 34 (FIGS. 2 and 3), it is possible to provide a mounting in such a way that the circumference of the winding drum 34 can be rotated about its axis of rotation in relation to the busbar laying unit 26.

A busbar 5 can be, for example, a tin-plated copper rail, having a width of preferably 5 mm to 10 mm and a thickness of, for example, 0.04 mm to 0.2 mm. If heating wire is not yet laid, the busbar 5 is laid directly on the base film 3 and, for example, adhesively bonded thereto. The pressure roller 1 can be heated for the adhesive bonding procedure and is thus used as an adhesive roller. If a lower busbar 31 (see FIG. 6) is already located on the base film 30 or 3, respectively, and heating wires 32 (see FIG. 6) are laid, the busbar 5 then to be laid is used as the upper busbar 33 (see FIG. 6) of a busbar pair and is soldered to the heating wires 32 and the lower busbar 31. The base film 3 or 30 laid with heating wires 32 and busbars 31 and 33 can then be covered with a further film to form a film laminate.

The soldering can be performed by means of soldering units (not shown separately here). However, it is advantageous to also effectuate the soldering by means of the pressure roller 1, preferably during the laying of the upper busbar 33. For this purpose, the temperature of the pressure roller can correspondingly be set high and/or the movement speed can be adapted. The heating to the generally higher soldering temperature can take place, for example, during the laying of the heating wires 32. The solder material can already be applied to the busbar, for example, as a layer material, or can be supplied separately. The pressure roller 1 can thus be used solely as a pressure roller, as an adhesive roller, or also as a soldering roller. However, it is also possible to provide a busbar laying unit with two pressure rollers 1, of which one can function as an adhesive roller and the other as a soldering roller.

Figure 6:
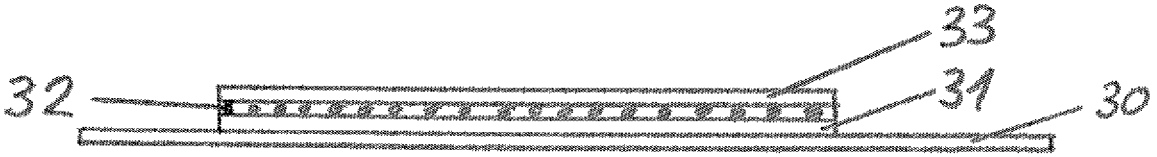
FIG. 6 shows a side view of heating wires between a pair of busbars located on a film in accordance with embodiments of the present disclosure.

Alternatively, it can also be provided that a busbar double laying unit (not shown in the figures) is provided, in which at least one guide channel 4 (see more detailed explanation below) and the pressure roller 1 are installed in at least double embodiment closely adjacent to one another on a common rotational drive vertically above the pressure point 10. The two individual sub-devices of this busbar double laying unit can be used in such a way that one of the busbar laying subunits operates as a laying device for adhesively bonding the lower busbar 31 at an adhesive bonding temperature suitable for the adhesive bonding on the base film 3 and the other busbar laying subunit is used as a soldering device having, for example, higher temperature for soldering the upper busbar 33 to the heating wires 32 and the lower busbar 33 (FIG. 6).

Furthermore, different busbar laying units 26 can alternatively be provided for the laying of the lower busbar 31 (FIG. 6) and the upper busbar 33 (FIG. 6), i.e., two complete and separate busbar laying units 26 are provided for the lower busbar 31 and the upper busbar 33, which can be moved by means of separately movable and separately controllable guide units, for example, carriages, preferably both on the same guide path. In this case, both busbar laying units 26 preferably have starting positions opposing one another, for example, the busbar laying units 26 for the lower busbar 31 on a drive side of the winding drum 34 and the busbar laying units 26 for the upper busbar 33 on the side of the winding drum 34 opposite to the drive side.

The busbar 5 to be laid is supplied via a guide unit 35, which is preferably adapted to the dimensions of the busbar 5 and has the guide channel 4, from a stock roller 6 to the pressure roller 1, wherein the feed of the busbar 5 is effectuated via a driven feed roller 7 of a feed unit 2. The guide channel 4, which can have a length of 50-200 mm, for example, and preferably ends as close as possible to a pressure point 10 below the pressure roller 1 can be open on top or preferably can be closed at least over a section in the cross-sectional circumference, to the extent the feed roller 7 or another instrument is not to act on the busbar 5. The busbar 5 can slide over a wall of the guide channel 4 opposite to the feed roller 7. Alternatively, a counter pressure roller (not shown here), which preferably has a floating mounting, can be provided, against which the feed roller 7 presses the busbar 5. For this purpose, a gap in the guide channel 4 permitting the access of the counter roller to the busbar 5 can be provided.

The feed roller 7 and—if provided—optionally also the counter roller can be rubber coated or provided with at least one outer rubber ring (not shown here).

The guide channel 4 can be variable in its width for adaptation to different widths of the busbar 5 to be laid and for this purpose can consist, for example, of two guide channel parts (not shown here) displaceable in relation to one another. Moreover, the guide channel 4—in contrast to that shown in FIG. 1—can have a course which is un-curved, i.e., linear in its longitudinal extension at least in sections.

A cutting blade 9, which can act to sever the busbar 5, for example, by a linear movement or a pivot movement, through a cutting slot 11 in the guide channel 4, is located on a cutting device 8, which is only symbolically shown by an arrow in FIG. 1. The manner of the feed of the busbar 5 or the construction of the cutting device 2 can also be achieved in another technical manner, for example, by means of a laser instead of the cutting blade 9. In particular the arrangement of the feed unit 2 or the cutting device 8 in relation to the guide channel 4 can be selected differently, for example, the cutting device 8 below the guide channel 4.

However, the arrangement of the cutting device 8 in front of the pressure roller 1 in the feed direction of the busbar 5 is essential. By way of a suitable control of feed of the busbar 5 in the guide channel 4, the movement of the pressure roller 1, and the operation of the cutting device 9, it is possible for the end of a severed busbar 5 to reach the pressure point 10 below the pressure roller 1 precisely when it is at the point at which the busbar 5 is also to end in the finished product. Complex trimming off of an otherwise excess busbar piece or a subsequent removal of an excessive amount of laid busbar material is not necessary. In particular, a manual engagement during the laying of the busbar 5 can be completely omitted.

The control device or unit 50 can also feed the busbar 5 to be laid in such a way that the beginning of the busbar 5 has precisely reached the pressure point 10 when the pressure roller 1 is located at the desired starting point at the start of the laying process.

In order that short busbars 5 can also be laid without cutting waste if needed, the cutting device 8 can be arranged so that the cutting blade 9, or possibly an alternative cutting means, acts at the least possible distance from the pressure point 10 on the busbar 5, for example, at a distance of at most 60 mm, preferably at most 50 mm, or more preferably at most 40 mm. For this purpose, the cutting device 8 is to be arranged as close as possible to the front end of the guide channel 4.

To avoid slipping or jumping of the busbar 5 off of the pressure roller 1, it can be advantageous to have the busbar 5 extend as flatly as possible in relation to the base film 3 in a region between the pressure point 10 and the guide channel 4, A force of the busbar 5 acting radially in relation to the pressure roller 1 and thus the risk of its jumping or slipping off is thus reduced. The distance of the busbar 5 from the base film 3 given perpendicularly to the base film 3 is preferably at most 2 mm, preferably at most 1 mm at a distance of 3 mm from the pressure point 10.

The busbar laying unit 26 preferably has a linear guide 12, for example, having a driven guide unit, for example, as a carriage. In addition, the busbar laying unit 26 can have a rotational drive 13, which preferably supports the pressure roller 13. A three-axis automatic movement sequence of the pressure roller 1 in relation to the base film 3 or 30, respectively, can be implemented by an additional relative movement of the film support transversely to the linear guide. If the film support is a winding drum 34, the relative movement can be effectuated, for example, by a finely-controllable rotation of the winding drum 34.

Figure 2:
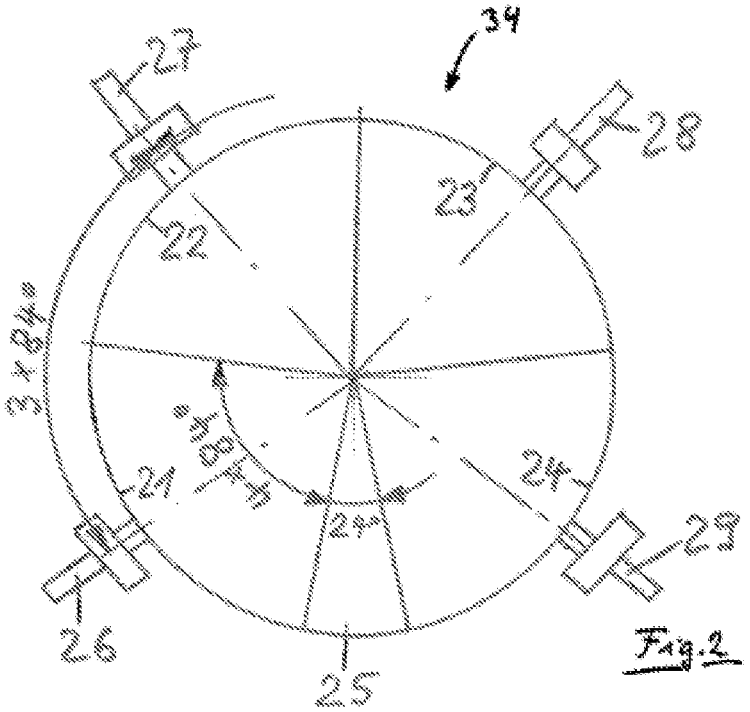
FIG. 2 shows an arrangement of four base films and a discard film on a winding drum with four busbar laying units in accordance with embodiments of the present disclosure.
Figure 4:
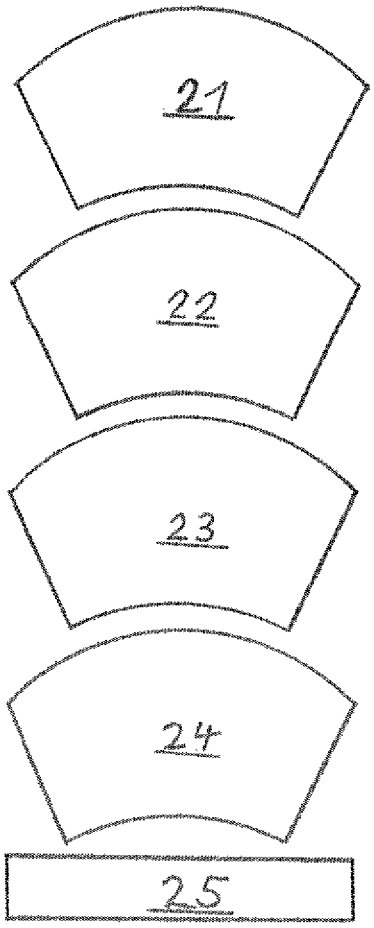
FIGS. 4 and 5 are diagrams of alternative distributions of base films and a discard film as employed with the arrangements of FIGS. 2 and 3, respectively.

FIG. 2 shows a winding drum 34 having four laid base films 21-24 and a discard film 25 in cross section. The region for the discard film 25 results from the laying process for the heating wires (not shown in FIG. 2). The distribution of the base films 21-24 and the discard film 25 is shown in FIG. 4. The base films 21-24 each have a shape typical for windshields, for example. Other shapes of the base films 21-24 are also possible. The distribution of the base films 21-24 is in the same direction according to FIG. 4, i.e., the longer curved sides are each on top in FIG. 4. Four separate busbar laying units 26-29 are distributed around the circumference of the winding drum 34 in FIG. 2, so that all base films 21-24 can be processed simultaneously by the busbar laying units 26-29. Therefore, four busbars 5 can be laid simultaneously, preferably using completely identical movement patterns of the busbar laying units 26-29. An equal circumferential angle can be provided four times for the installation of the busbar laying units 26-29 for this purpose, for example, of four times 84°, if the circumferential angle for the region of the discard film 25 is 24°.

Figure 3:
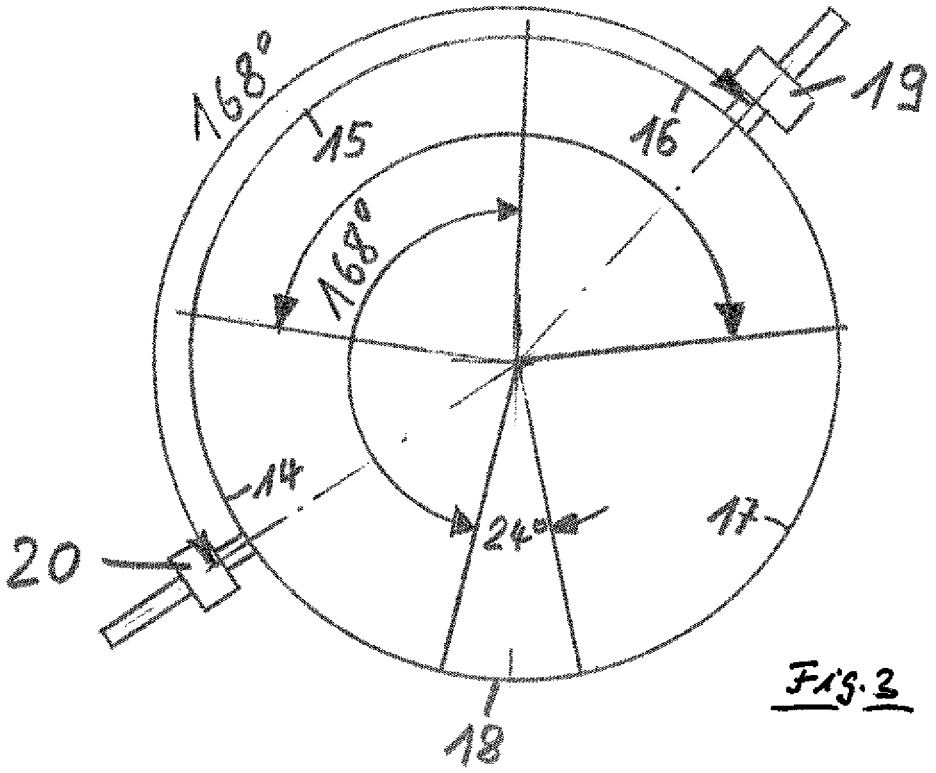
FIG. 3 shows an arrangement of four base films and a discard film with two busbar laying units in accordance with embodiments of the present disclosure.
Figure 5:
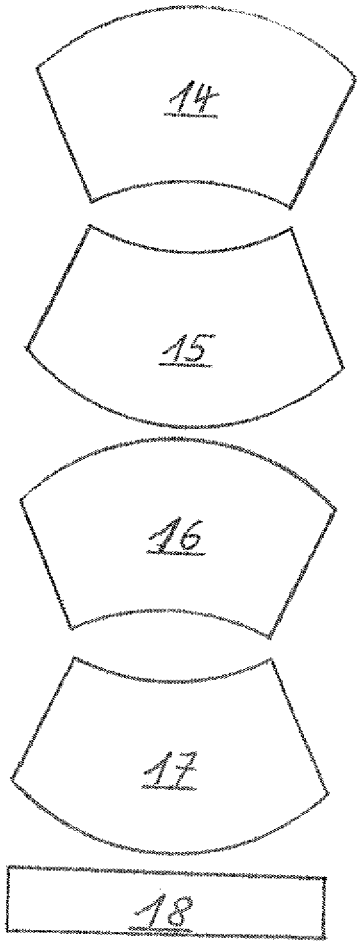

FIGS. 3 and 5 show an alternative arrangement of four base films 14-17 on the circumference of the winding drum 34, namely in opposing directions, i.e., having the longer curved side alternately on the top and bottom in FIG. 5. Two busbar laying units 19 and 20 can be used here in such a way that two busbars 5 are laid simultaneously, preferably using completely identical movement patterns of the busbar laying units 19 and 20. For this purpose, a circumferential angle between the busbar laying units 19 and 20 can be provided which is, for example, 168°, if the circumferential angle for the region of the discard film 18 is 24°. In this manner, the base films 14 and 16, for example, can be processed simultaneously and the base films 15 and 17 can be processed simultaneously in a following pass, i.e., provided with busbars 5.

The description hereafter of FIGS. 2 and 4 also applies accordingly to the variant according to FIGS. 3 and 5 and to further conceivable variants having a differing number and differing shapes of base films.

The individual busbar laying units 26-29 can be installed at any point of the circumference of the winding drum 34.

A finely-controllable rotation of the winding drum 34 can be used as a controlled coordinate axis for all four busbar laying units 26-29 simultaneously in synchronizations.

It is apparent that instead of all or a subset of the busbar laying units 26-29, variants can also be provided as are mentioned above for the individual busbar laying unit 69 in FIG. 1, for example, in the form of busbar double laying units, in each of which at least guide channel and pressure roller are installed in at least a twofold embodiment adjacent to one another on a common rotational drive vertically above the pressure point 10. Alternatively, two complete and separate busbar laying units 26 can be provided for each or a subset of the base films 21-24 for laying lower busbars 31 and upper busbars 33.

It can also be provided that all busbar laying units 26-29 are arranged so they are movable in the circumferential direction on a frame (not shown here) of the winding drum 34 on guides (also not shown), wherein the guides can have adjustability in the direction of the winding drum circumference. At routine winding drum diameters, the adjustability can be up to, for example, 800 mm. A fine adjustment, for example, using clamping device, can be provided for this purpose. Adjustable guides enable the busbar laying units 26-29 to be positioned arbitrarily within the associated segment. Thus, for example, in the case of four uniformly distributed base films 21-24 having little film dimension in the circumferential direction with uniform intermediate gap between the films as the base position, the four busbar laying units 26-29 can accordingly be positioned closer together or farther apart from one another on the winding drum circumference.

Furthermore, an accompanying, preferably separately heated, separately mounted, and preferably mechanically separately cushioned pressing roll (not shown here) can be provided for the busbar laying unit 26 or one of the busbar laying units 26-29 or 19-20, which is arranged in the axial direction adjacent to the pressure roller 1, preferably at a slight distance from the pressure roller 1. The pressing roll can be used as a rolling device and runs in use on a, for example, 5-10 mm wide track on a narrow film web between the busbar pair and the film end. In this case, by means of a three-axis movement of the busbar laying unit 26 or 26-29 or 19-20, the heating wires on the track can be fastened sufficiently strongly on the base film 3 or 21-24 or 14-17, respectively, that the heating wires on or directly adjacent to this track can all be severed in a subsequent cutting procedure, without the heating wires 32 detaching from the base film 3 at the same time. This track can extend closely adjacent to the laid busbar pair and it can have uniform distance from this busbar pair.

Attaching a further cutting device (not described in greater detail here), for example, having rolling cutter or having fixed cutter or having double rolling cutter with, for example, 2 mm spacing and application of electrical voltage between the two cutters to burn the heating wire residues located in between, to the busbar laying unit 26 or 21 of the busbar laying units 26-29 or 19-20 can also be provided. The further cutting device can, by means of a three-axis movement of the busbar laying unit 26 or one of the busbar laying units 26-29 or 19-20 on or closely adjacent to the track fastened with the above-described pressing roll, sever all heating wires of this track without cutting through the base film at the same time.

Installing or adhesively bonding narrow film strips below and above the heating wires 32 between all base films 21-24 or 14-17 (FIGS. 4 and 5) manually or using an automatic film unrolling device (not described in greater detail) can also be provided. Using these strips and the interposed heating wires 32, after the above-described severing of all heating wires 32, all wires up to the cutting line can be rapidly removed by manually drawing off this film strip having the wires glued therein.

It can also be provided that the above-mentioned rolling device and/or the above-mentioned further cutting device and/or the above-mentioned film unrolling device have separate guides arranged parallel to the drum axis. In this manner, they can be integrated separately into the overall cycle.

Finally, it can be provided that all described process steps can run as an automatic program using an electrical or electronic control system.

List of reference numerals:

| | |
|---|---|
| 1 | pressure roller |
| 2 | feed unit |
| 3 | base film |
| 4 | guide channel |
| 5 | busbar |
| 6 | stock roller |
| 7 | feed roller |
| 8 | cutting device |
| 9 | cutting blade |
| 10 | pressure point |
| 11 | cutting slot |
| 12 | linear guide |
| 13 | rotational drive |
| 14 | base film |
| 15 | base film |
| 16 | base film |
| 17 | base film |
| 18 | discard film |
| 19 | busbar laying unit |
| 20 | busbar laying unit |
| 21 | base film |
| 22 | base film |
| 23 | base film |
| 24 | base film |
| 25 | discard film |
| 26 | busbar laying unit |
| 27 | busbar laying unit |
| 28 | busbar laying unit |
| 29 | busbar laying unit |
| 30 | base film |

-continued

| List of reference numerals: | |
|---|---|
| 31 | lower busbar |
| 32 | heating wires |
| 33 | upper busbar |
| 34 | winding drum |
| 35 | guide unit |

The invention claimed is:

1. A method for laying busbars in films, in which a bundle of heating wires and at least two busbars, each electrically contacting at least one subset of the heating wires, are applied to at least one base film, wherein the busbars are each guided by means of a guide unit in the direction of a pressure roller and are pressed by means of the pressure roller in the direction of the base film and are severed by means of a cutting device, wherein seen in the guide direction the busbars are each severed before the pressure roller.

2. The method as claimed in claim 1, wherein the guide unit comprises a guide channel, and wherein the busbars are severed before a front end of the guide channel.

3. The method as claimed in claim 1, wherein the respective busbar extends flatly in relation to the film between a pressure point defined by the pressing of the busbar by means of the pressure roller on the base film and the guide unit in such a way that at a distance of 3 mm, the distance of the busbar from the film perpendicular to the film is at most 2 mm.

4. The method as in claim 1, wherein the pressure roller is heated.

5. The method as claimed in claim 1 wherein the busbars are adhesively bonded on the base film and the adhesive bonding process is effectuated or assisted by means of heat introduced by the pressure roller.

6. The method as claimed in claim 1, wherein the busbars are soldered with the heating wires or a subset of the heating wires and the soldering process is effectuated or assisted by means of heat introduced by the pressure roller.

7. The method as claimed in claim 6, wherein the pressure roller is operated at different temperatures for laying the busbars and for soldering the heating wires.

8. The method as claimed in claim 1, wherein, in the case of a plurality of base films distributed on a circumference of a winding drum, busbars are applied simultaneously to at least two of the base films.

9. A device for laying busbars in films, comprising at least one busbar laying unit having a guide unit for supplying a busbar to a pressure roller pressing the busbar in the direction toward the base film and a cutting device for severing the busbar, wherein the cutting device is arranged and configured in such a way that seen in the feed direction the busbar is severed before the pressure roller.

10. The device as claimed in claim 9, further comprising a control unit, which is configured, for the busbar laying unit or at least one of the busbar laying units, to control a feed for the busbar and the operation of the cutting device in such a way that the laid busbar has a final length desired for a finished product without further trimming.

11. The device as claimed in claim 9, wherein the pressure roller is heated on the busbar laying unit or on at least one of the busbar laying units.

12. The device as claimed in claim 9 further comprising a plurality of busbar laying units, wherein the busbar laying units have separate guides.

13. The device as claimed in claim 12, further comprising a controller, using which at least two of the busbar laying units, preferably all busbar laying units, are controlled simultaneously for laying one of the busbars each.

14. The device as claimed in claim 12, further comprising a winding drum for accommodating the base film or a plurality of base films, wherein the busbar laying units are arranged distributed on the circumference of the winding drum.

15. The device as claimed in claim 9, wherein the distance between a cutting point of the cutting device and a pressure point defined by the pressing on of the busbar by means of the pressure roller is at most 50 mm.

16. The device as claimed in claim 9, wherein the guide unit has a guide channel adjustable in its width.

17. The device as claimed in claim 9, wherein the guide unit has a feed unit having at least one driven feed roller acting on an upper wide side of the respective busbar.

18. The device as claimed in claim 17, wherein the guide unit has a counter roller, which is opposite to the driven feed roller, acts on a lower wide side of the busbar, and is preferably not driven.

* * * * *